US006503014B2

(12) United States Patent
Louis et al.

(10) Patent No.: US 6,503,014 B2
(45) Date of Patent: Jan. 7, 2003

(54) DECORATIVE CONTAINER WITH APPLICATOR

(75) Inventors: Donna M. Louis, Valencia, CA (US); Stephanie Moore, Los Angeles, CA (US)

(73) Assignee: Worldwide Cosmetics, North Hollywood, CA (US)

( * ) Notice: Subject to any disclaimer, the term of this patent is extended or adjusted under 35 U.S.C. 154(b) by 0 days.

(21) Appl. No.: 10/104,858

(22) Filed: Mar. 22, 2002

(65) Prior Publication Data

US 2002/0159820 A1 Oct. 31, 2002

Related U.S. Application Data

(63) Continuation of application No. 29/140,849, filed on Apr. 25, 2001.

(51) Int. Cl.[7] ..... A46B 11/00

(52) U.S. Cl. ..... 401/126; 401/129; 401/195; 401/131; D9/337; D9/338; D28/4; D28/6

(58) Field of Search ..... 401/126, 129, 401/128, 130, 195, 131; D28/4–6, 35, 36, 10; 132/218, 216, 317, 320; D9/337, 338

(56) References Cited

U.S. PATENT DOCUMENTS

| | | | | |
|---|---|---|---|---|
| 1,650,028 A | | 11/1927 | Morrison | |
| D147,265 S | * | 8/1947 | Gardiner | D9/137 |
| D155,043 S | | 8/1949 | Serra | |
| D170,426 S | * | 9/1953 | Mullen | D9/337 |
| D174,541 S | * | 4/1955 | Gavin | D9/337 |
| D180,715 S | | 7/1957 | Henry et al. | |
| 2,803,028 A | * | 8/1957 | Flynn | 15/140.4 |
| 2,917,766 A | * | 12/1959 | Ciffo | 15/140.4 |
| D191,146 S | | 8/1961 | Sinrod | |
| 3,103,032 A | * | 9/1963 | Brenne | 401/126 |
| 3,964,709 A | | 6/1976 | Labelle et al. | |
| D246,509 S | | 11/1977 | Hytken | |
| 4,709,821 A | | 12/1987 | Guiffray | |
| D395,240 S | | 6/1998 | Dinand | |
| D408,276 S | | 4/1999 | Sims et al. | |
| D425,785 S | | 5/2000 | Hirato et al. | |

FOREIGN PATENT DOCUMENTS

CH 403184 6/1966

OTHER PUBLICATIONS

Better Homes & Gardens Oct. 1951, p. 96: Borden's advertisement with ice cream cone at bottom of page.
Modern Salon, Aug. 1978, p. 40: "The Perfect Balance Of Science, Professional Excellence, And Fashion In Salon Nail Care," Tilt–A–Matic Professional Bottle.

* cited by examiner

*Primary Examiner*—David J. Walczak
(74) *Attorney, Agent, or Firm*—SAIDMAN DesignLaw Group

(57) ABSTRACT

A container for nail polish shaped to simulate ice cream in a cone that has been dropped upside down on the ground. The container includes a cap, an applicator, and a bottle. The cap is conical and has an outer surface with a pattern of projections thereon to aid in simulating an ice cream cones The applicator is coupled to the cap and preferably is a brush. The bottle is generally spherical in shape and simulates a scoop of ice cream. When the cap is on the bottle, the applicator is within the bottle and contacts a substance, such as nail polish, within the bottle. When the container is in a resting position, the bottle simulating the scoop of ice cream is below the cap simulating the cone, and the ice cream may appear to be melting.

27 Claims, 3 Drawing Sheets

DECORATIVE CONTAINER WITH APPLICATOR

CROSS-REFERENCE TO RELATED APPLICATION

This application is a continuation of our prior pending application Ser. No. 29/140,849, filed Apr. 25, 2001, which is incorporated by reference herein in its entirety.

BACKGROUND OF THE INVENTION

1. Field of the Invention

The present invention relates to a container, and more particularly, to a decorative container with an applicator , such as for nail polish.

2. Description of Related Art

Many containers for holding many different types of substances are known. Some containers, for example, are designed to hold a cosmetic composition, such as nail polish. Such containers generally include a cap, a brush coupled to the cap, and a bottle for accommodating the brush therein. The cap is adapted to cooperate with the bottle. In a closed position, the brush is within the bottle and can contact the contents (i.e., nail polish) of the bottle.

Some of such containers are configured so that the bottle and cap are substantially vertical during use. When the user removes the cap and extracts the brush, the brush has adequate nail polish on it to apply to the nails. Another variety of such containers has a flat bottom surface and an angled surface, such as a container known as the "Tilt-A-Matic" bottle. When this container is resting on a flat bottom surface, the bottle is in a substantially vertical position. When this container is resting on an angled surface, the bottle is in a tilted position that makes dispensing the nail polish purportedly neater and more professional.

Yet other containers are formed of pliant materials so that they can be squeezed to dispense the contents. Such containers are disclosed in U.S. Pat. No. Des. 246,509 entitled "Toothpaste Tube" and U.S. Pat. No. Des. 191,146 entitled "Collapsible Dispensing Tube." In contrast, nail polish containers are not formed of pliant materials since, instead of being squeezed to dispense the contents, a brush is used to dispense and apply the contents of the container.

A manufacturer of cosmetics is always keen for new design ideas that help to distinguish the manufacturer's product from those of others. Normally, such ideas focus on designing distinctive product packaging and trademarks.

Containers for cosmetics such as nail polish, by and large, have the appearance of a plain glass bottle into which the brush applicator is inserted. The brush is attached to a cap that screws onto the bottle. Although the shape of the bottle and the shape of the cap can take various forms (see, e.g., U.S. Pat. Nos. Des. 155,043 and 180,715), the notion of shaping the cap and bottle of, e.g., a nail polish container to resemble another common item or product is believed to be unique.

The present invention was developed with the above-noted general object in mind.

SUMMARY OF THE INVENTION

The invention is a container with a cap, an applicator, and a bottle, where the cap and the bottle are shaped to simulate a cone and ice cream, respectively. Preferably, the applicator is coupled to the cap, and the bottle selectively receives the applicator.

In one embodiment of the present invention, the bottle further includes nail polish. According to one aspect of the present invention the applicator is a brush.

In yet another embodiment, the bottle further includes a neck portion adapted to cooperate with the cap. Preferably in such an embodiment, the neck portion further includes a threaded portion for cooperating with the cap.

According to another aspect of the invention, the bottle may be configured to simulate melting ice cream. According to yet another aspect of the invention, the container during use simulates an ice cream cone that has an inverted position. Such as, when the ice cream in the cone is located on a surface, such as when dropped on the ground or placed on a plate, table, etc. As a result, the scoop of ice cream (simulated by the bottle) is positioned under the cone (simulated by the cap).

According to another embodiment of the present invention, the inventive container comprises a cap, an applicator, and a bottle. The cap includes a cap outer surface with a cap pattern. The cap pattern simulates an ice cream cone pattern. The applicator is coupled to the cap, and the bottle receives the applicator. Additionally, the bottle includes a bottle outer surface with a bottle pattern. The bottle pattern simulates a scoop of ice cream and is different from the cap pattern.

In one embodiment of such container, the cap pattern includes a network of projections. In another embodiment, the bottle pattern may simulate a scoop of melting ice cream.

According to yet another embodiment of the present invention, the container comprises a cap configured to simulate an ice cream cone, an applicator coupled to the cap, and a bottle. The bottle receives the applicator, and includes a bottle outer surface configured to simulate a scoop of ice cream. The bottle outer surface includes at least one surface portion for maintaining the container in a resting position. Furthermore, the bottle configured to simulate a scoop of ice cream is positioned below the cap configured to simulate an ice cream cone. As a result, the container during use simulates an ice cream cone where the ice cream in the cone has been located on a surface in an inverted position, such as when placed on a plate, dropped on the ground, or the like.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
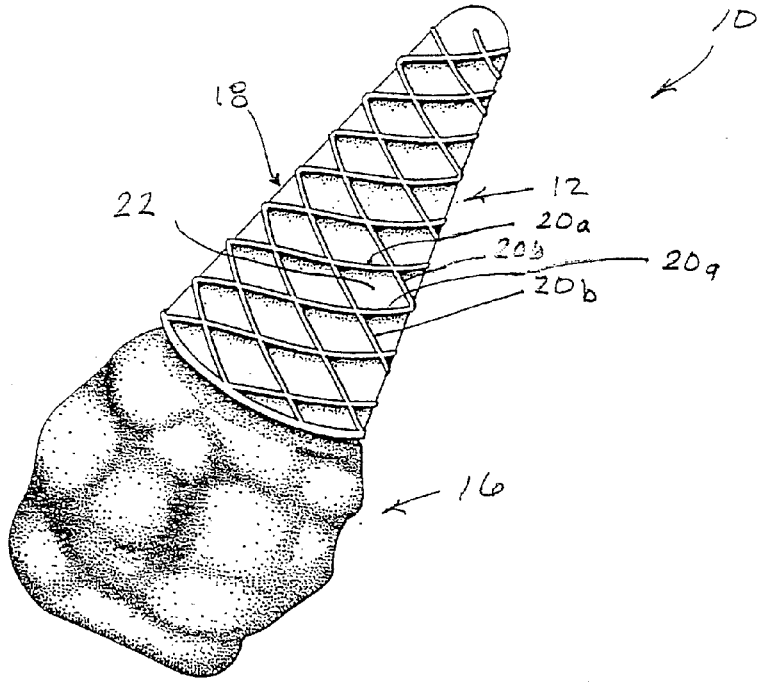
FIG. 1 is a perspective view of a container of the present invention, wherein a cap is on a bottle.

Referring now to the drawings, wherein like reference numerals represent identical or corresponding parts throughout the several views, and more particularly to FIGS. 1–6 thereof, a container of the present invention is indicated generally by reference numeral 10.

Figure 2:
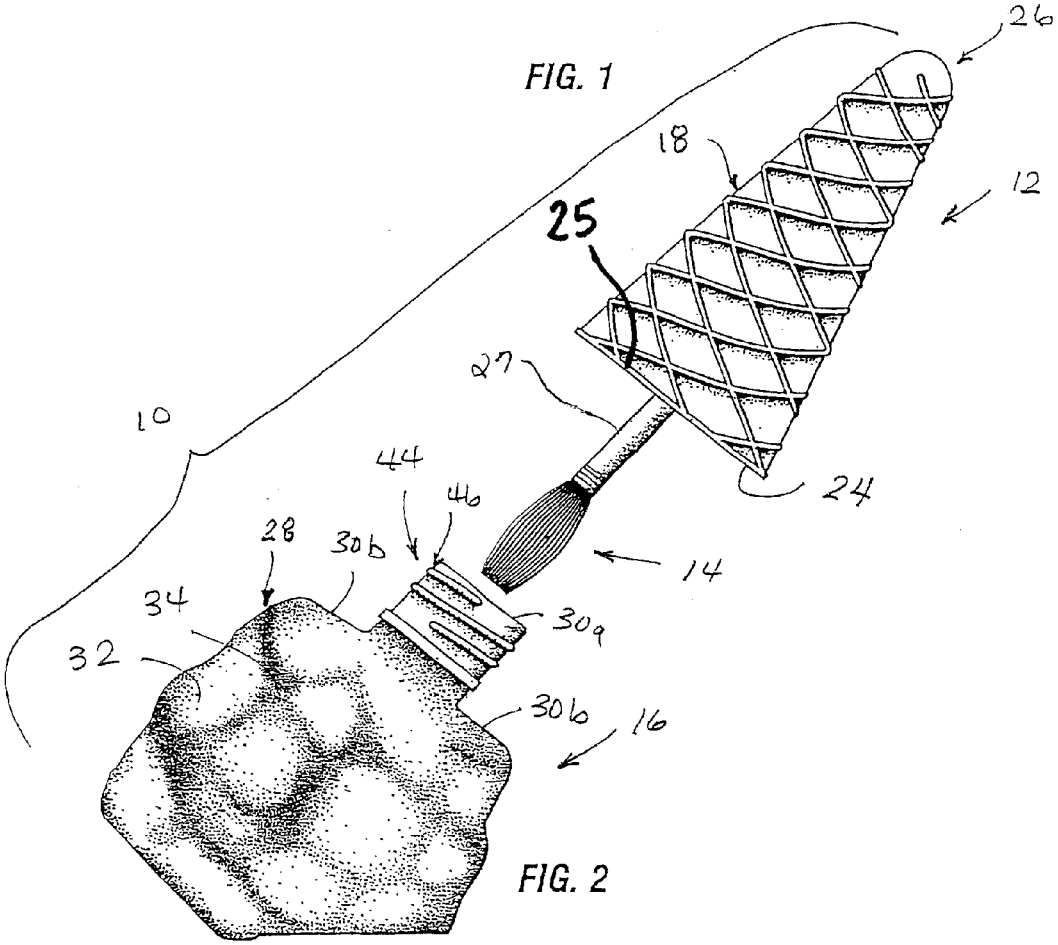
FIG. 2 is a side view of the container of FIG. 1, wherein the cap is removed from the bottle so that a brush is now visible, and the bottle is in a tilted position.

Referring to FIGS. 1 and 2, container 10 generally comprises a cap 12, an applicator 14, and a bottle 16. The cap 12 is configured to simulate an ice cream cone. More specifically, the cap 12 includes a cap feature related to ice cream. As discussed below, the cap feature can be a cap pattern and/or the shape of the cap that simulates an ice cream cone. The cap 12 includes an outer surface 18 with a cap pattern thereon. The cap pattern is formed by sets of projections or ridges 20*a* and 20*b* on the outer surface 18. In this embodiment, the sets of projections 20*a* repeatedly cross the sets of projections 20*b* to form a network or crisscross pattern with interstitial spaces 22 between the projections 20*a,b*. The interstitial spaces 22 are generally shaped like polygons, such as diamonds. However, as will be apparent to one of ordinary skill in the art, the present invention does not need to be limited to projections forming diamond shaped interstitial spaces, since other shapes will suggest themselves, This network of projections enhances the ability of the cap 12 to look like an ice cream cone, In addition, the cone can be a light color (e.g., tan), so as to resemble a "cake" cone, or a dark, brown color, if desired, so as to resemble a "sugar" or chocolate cone.

Referring to FIG. 2, in this embodiment, the cap 12 further includes an enlarged end 24 and a rounded free end 26. The cap 12 tapers from the enlarged end 24 to the free end 26 so that the cap 12 has a generally conical shape like that of one type of ice cream cone. A rim 25 may be formed about the opening forming enlarged end 24. Again, as will be apparent to one of ordinary skill, the present invention is not limited to this particular shape so long as the cap simulates an ice cream cone.

Again referring to FIG. 2, the applicator 14 is coupled to the cap 12 by a cylindrical shaft 27. Preferably, the applicator 14 is a brush, as illustrated in FIG. 2. However, as will be apparent to one of ordinary skill in this art, the present invention may comprise other types of applicators, such as foam pads, and such applicators may be secured to cap 12 in any of a variety of ways, all well known in the art.

Figure 5:
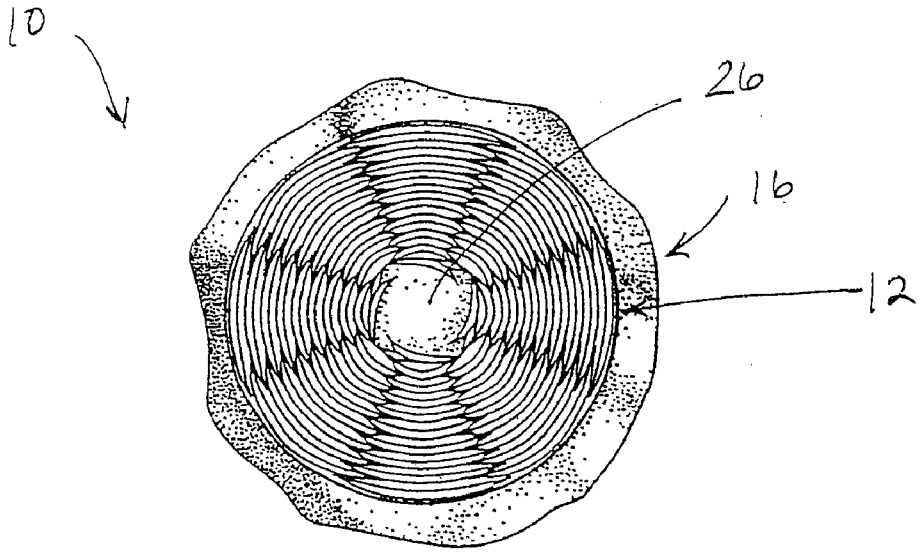
FIG. 5 is an enlarged, top view of the container of FIG. 1.

Referring to FIGS. 1, 2, and 5, the bottle 16 has a generally spherical shape (as best seen in FIG. 5), and is configured to simulate ice cream. More specifically, the bottle 16 includes a bottle feature related to ice cream and related to the cap feature. As discussed below, the bottle feature can be a bottle pattern and/or the shape of the bottle that simulate a scoop of ice cream. The bottle feature is different from the cap feature and related only to a scoop of ice cream. The bottle 16 includes an outer surface 28 with a bottle pattern thereon and a top surface formed of top surface portions 30*a,b*. Top surface portion 30*a* is elevated above top surface portions 30*b*. The bottle pattern on the bottle outer surface 28 is different from the cap pattern on the cap outer surface 18. The bottle pattern preferably enhances the ability of the bottle 16 to look like ice cream. In this embodiment, the bottle pattern is irregular and formed by a plurality of raised and depressed areas 32 and 34, respectively. The illustrated irregular bottle pattern is exemplary of a bottle pattern that would be formed when a scoop of ice cream is separated out of a container of ice cream, or that would be formed when ice cream is eaten or allowed to melt. The present invention, as is apparent to one of ordinary skill, is not limited to the particular illustrated bottle pattern so long as the bottle simulates ice cream as described above. For example, the bottle pattern can be substantially smooth to simulate a smooth scoop of ice cream.

Figure 3:
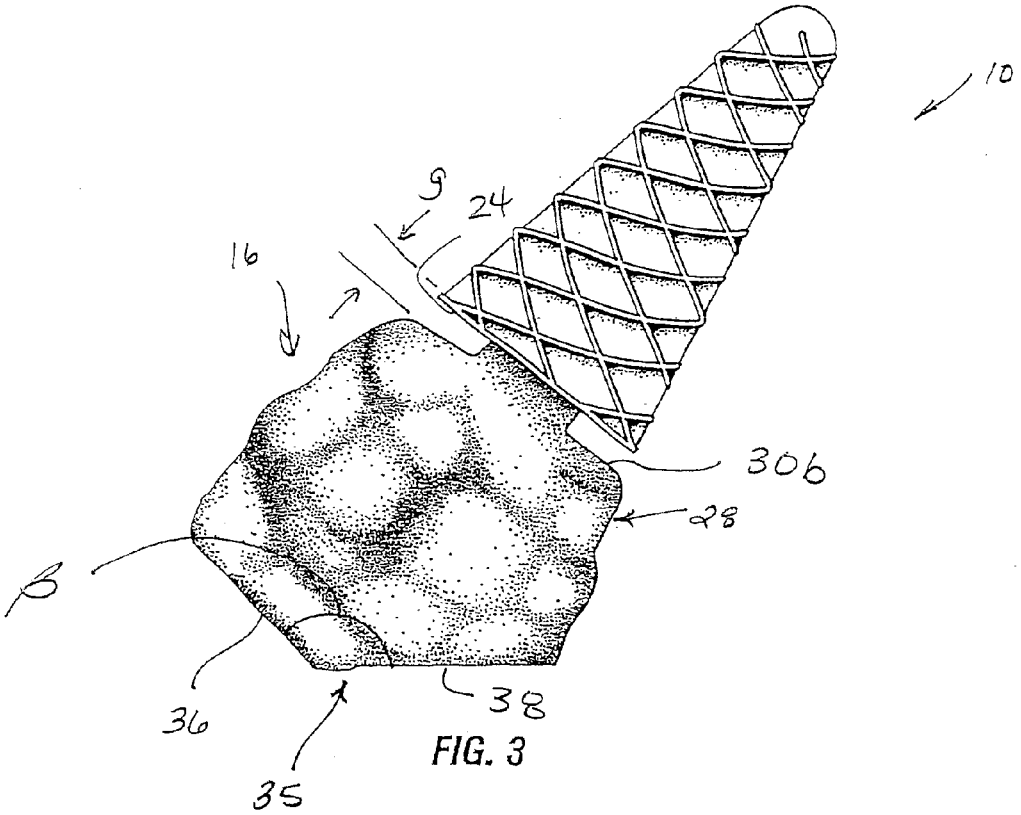
FIG. 3 is a side view of the container of FIG. 1, wherein the cap is on the bottle so that the brush is no longer visible.
Figure 4:
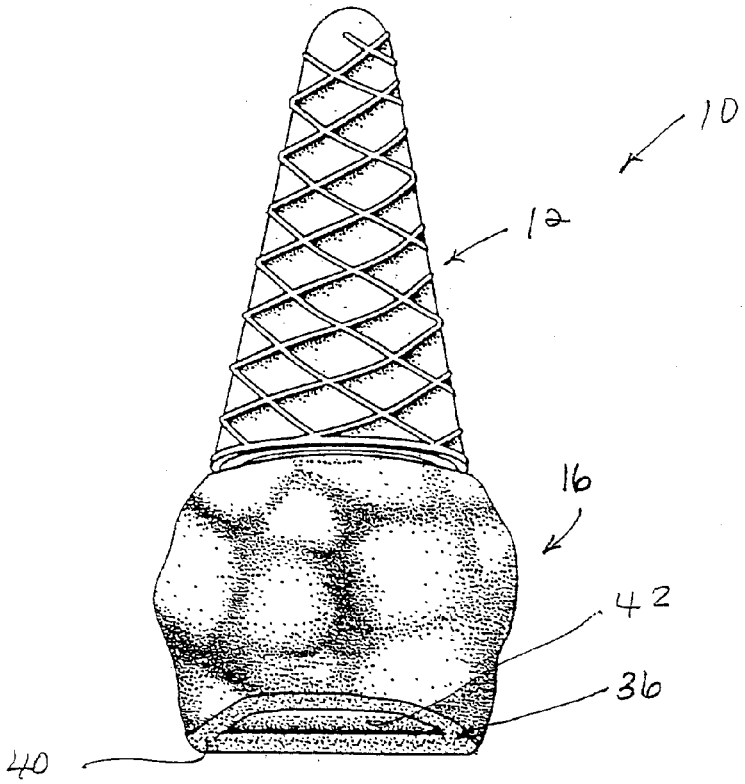
FIG. 4 is a back view of the container of FIG. 1, wherein the bottle is in the tilted position.
Figure 6:
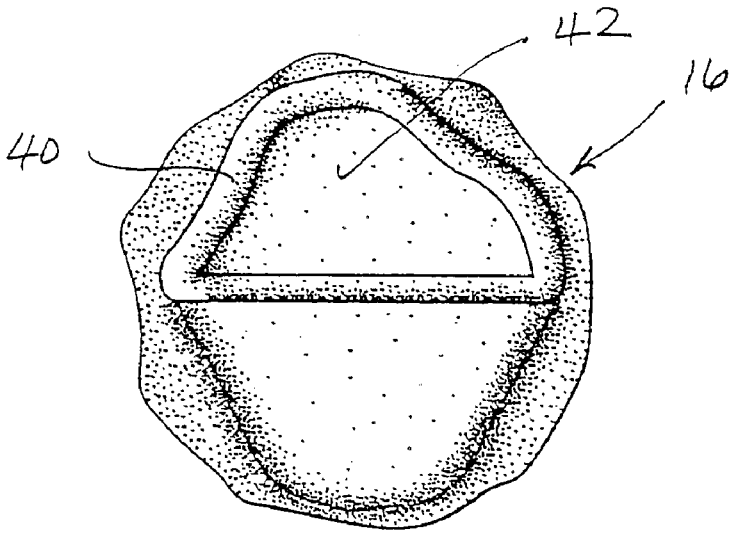
FIG. 6 is an enlarged, bottom view of the container of FIG. 1.

Turning to FIGS. 2–3, in this embodiment, the outer surface 28 of the bottle 16 further includes a bottom surface 35 with first and second surface portions 36 and 38. The first surface portion 36 and the top surfaces 30*a,b* are spaced apart and substantially parallel to one another. As shown in FIGS. 4 and 6, the first surface portion 36 has a peripheral ridge 40 extending therefrom. First surface portion 36 is generally flat, as shown in FIG. 3. Ridge 40 raises the bottle 16 slightly above the surface on which it is placed and allows the bottle 16 to more easily rest on a flat surface. As best seen in FIG. 4, the first surface portion 36 further includes a depression 42 formed within the peripheral ridge 40. Both the ridge 40 and depression 42 are optional.

The second surface portion 38 is adjacent to and angularly offset from the first surface portion 36 so that an angle β (FIG. 3) is formed between surface portions 36 and 38. In this embodiment, the angle β is preferably about 140°. Obviously, other angles will also function as desired.

Referring to FIGS. 1 and 2, the bottle 16 selectively receives the brush 14. The bottle 16 further includes a neck portion 44 adapted to cooperate with the cap 12. The bottle 16 is adapted to receive and contain a cosmetic substance that can be contacted by and applied by the brush 14, such as base coat or top coat nail polish and the like, or any other liquid, gel or powder, such as glitter in a liquid suspension. The neck portion 44 includes a threaded portion 46 that cooperates with cap 12 in a conventional manner to allow cap 12 to be removably secured to the bottle 16.

Referring to FIG. 3, in the present embodiment, the cap 12 is formed so that the enlarged end 24 is spaced from the top surface portion 30*b* of the bottle 16 so that a gap g is formed to prevent the cap from touching bottle 16.

The bottle 16 may be made of any conventional material, such as a translucent, opaque, or transparent material, e.g., glass or plastic. The cap 12 may also be made of any desired material, e.g., plastic.

Use of the container will now be discussed with reference to FIGS. 1 and 2. In a tilted resting position, shown in FIGS. 2–4, the second surface portion 38 supports the bottle 16. In the tilted resting position, the cap 12 is elevated or raised, and disposed at an angle offset from vertical. In the tilted resting position, as well as in its other position, the bottle 16 simulating the ice cream is below the cap 12 simulating the cone. This suggests that one has located the ice cream in the cone on a surface, such as when the cone is dropped on the ground or placed on a plate, table, or the like. Thus, for the most effective simulation, bottle 16 is shaped to resemble ice cream, as illustrated. Furthermore, the bottle 16 may be shaped to resemble melting ice cream.

In the vertical resting position, the first surface portion 36 supports the bottle 16. In the vertical resting position, the cap 12 will be substantially vertically oriented and elevated.

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims. Therefore, this invention is not to be limited to the specifically preferred embodiments depicted therein. The invention is a container with a cap, an applicator, and a bottle, where the cap and bottle are shaped to simulate a cone and ice cream, respectively. Thus, the details of these shapes as set forth in the above-described preferred embodiment, should not limit the scope of the present invention.

Further, the purpose of the Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. A container, which comprises:

a cap including a first end and a second end, said cap being widest at said first end, and said cap further including a cap outer surface comprising a cap pattern that simulates an ice cream cone pattern;

an applicator coupled to the cap; and a bottle for selectively receiving the applicator, said bottle being configured to simulate a scoop of ice cream, said cap and applicator being removable from said bottle and in a closed position said bottle is adjacent said first end of said cap.

2. The container of claim 1, wherein said bottle further includes nail polish.

3. The container of claim 1, wherein said applicator is a brush.

4. The container of claim 1, wherein said bottle further includes a neck portion adapted to cooperate with said cap.

5. The container of claim 4, wherein said neck portion further includes a threaded portion for cooperating with said cap.

6. The container of claim 1, wherein said bottle further includes an irregular outer surface.

7. The container of claim 6, wherein said bottle further includes a top surface portion, and said outer surface further includes a bottom surface portion spaced from said top surface portion and substantially parallel to said top surface portion, and said bottom surface portion includes a peripheral ridge extending from said bottom surface portion to form a depression within said peripheral ridge.

8. The container of claim 1, wherein said bottle is configured to simulate melting ice cream.

9. The container of claim 1, wherein said bottle further includes an outer surface having a bottom surface with a first surface portion and a second surface portion adjacent said first surface portion and angularly offset from said first surface portion.

10. The container of claim 1, wherein said container during use simulates an ice cream cone that has been dropped on the ground, whereby said scoop of ice cream is positioned under said cone.

11. A container which comprises:

a removable cap including a cap outer surface with a cap pattern that simulates an ice cream cone pattern, said removable cap simulating an entire ice cream cone;

an applicator coupled to said cap; and a bottle for receiving said applicator, said bottle including a bottle outer surface with a bottle pattern that simulates a scoop of ice cream and is different from the cap pattern.

12. The container of claim 11, wherein said cap pattern includes a network of projections.

13. The container of claim 11, wherein said applicator is a brush.

14. The container of claim 11, wherein said bottle further includes a neck portion adapted to cooperate with said cap.

15. The container of claim 11, wherein said bottle pattern simulates a scoop of melting ice cream.

16. The container of claim 11, wherein said container during use simulates an ice cream cone that has been located on a surface, whereby said scoop of ice cream is positioned below said cone.

17. A container which comprises:

a cap including a cap outer surface comprising a cap pattern that simulates an ice cream cone pattern;

an applicator coupled to said cap; and a bottle for receiving said applicator, said bottle including a bottle outer surface configured to simulate a scoop of ice cream, and said bottle outer surface including at least one surface portion for maintaining the container in a resting position, where said bottle configured to simulate a scoop of ice cream is positioned below said cap configured to simulate an ice cream cone whereby said container during use simulates an ice cream cone that has been located on a surface.

18. The container of claim 17, wherein said applicator is a brush.

19. The container of claim 18, wherein said surface portion is generally flat.

20. The container of claim 19, wherein said cap further includes a cap outer surface with a cap pattern with a network of projections that simulates said ice cream cone and said bottle further includes a bottle outer surface with a bottle pattern that simulates said scoop of ice cream.

21. The container of claim 20, wherein said bottle further includes a neck portion adapted to cooperate with said cap.

22. The container of claim 20, wherein said bottle pattern is configured to simulate melting ice cream.

23. A container, which comprises:

a cap including at least one cap feature related to simulating an ice cream cone;

an applicator coupled to the cap; and a bottle for selectively receiving the applicator, said bottle including at least one bottle feature related only to simulating a scoop of ice cream, wherein said cap feature being related to said bottle feature and said cap and bottle features being related to simulating ice cream.

24. The container of claim 23, wherein said cap feature is a conical shape of said cap that simulates the ice cream cone.

25. The container of claim 23, wherein said cap feature is a cap pattern on an outer surface of said cap that simulates an ice cream cone pattern.

26. The container of claim 23, wherein said bottle feature is a generally spherical shape of said bottle that simulate the scoop of ice cream.

27. The container of claim 23, wherein said bottle feature is a bottle pattern on an outer surface of said bottle, said bottle pattern simulates a scoop of melting ice cream.

* * * * *